US005967523A

United States Patent [19]

Brownlee

[11] Patent Number: 5,967,523

[45] Date of Patent: Oct. 19, 1999

[54] TARGET STAND

[76] Inventor: Wally Brownlee, P.O. Box 773, Watertown, S. Dak. 57201

[21] Appl. No.: 09/099,294

[22] Filed: Jun. 18, 1998

[51] Int. Cl.[6] ..... F41J 1/10

[52] U.S. Cl. ..... 273/407

[58] Field of Search ..... 273/407

[56] References Cited

U.S. PATENT DOCUMENTS

| | | | |
|---|---|---|---|
| D. 186,773 | 12/1959 | Bertschinger . | |
| D. 388,128 | 12/1997 | Young . | |
| 2,069,822 | 2/1937 | Douglas . | |
| 2,899,204 | 8/1959 | Ratay . | |
| 2,932,516 | 4/1960 | Penner . | |
| 3,415,519 | 12/1968 | Hand | 273/407 |
| 3,601,353 | 8/1971 | Dale . | |
| 4,029,318 | 6/1977 | Boss . | |
| 4,726,593 | 2/1988 | Wade . | |
| 4,913,389 | 4/1990 | McCracken . | |
| 5,067,683 | 11/1991 | Wagner . | |
| 5,209,492 | 5/1993 | Hamilton . | |
| 5,503,356 | 4/1996 | Shelby . | |
| 5,678,824 | 10/1997 | Fortier et al. . | |
| 5,725,217 | 3/1998 | White | 273/407 |

FOREIGN PATENT DOCUMENTS

| | | |
|---|---|---|
| 0 785 407 A2 | 7/1997 | European Pat. Off. . |
| WO 96/23190 | 8/1996 | WIPO . |

*Primary Examiner*—William H. Grieb

[57] ABSTRACT

A target stand for providing a sturdy lightweight device for holding a target above a surface. The target stand includes the target stand 10 generally comprises a base frame with a pivot bar interposed between the side bars of the base frame. One of the ends of the pivot bar is pivotally coupled to one of the side bars of the base frame while the other end of the pivot bar is pivotally coupled to the other side bar of the base frame. A pair of spaced apart elongate extension arms are included each having a pair of opposite ends. A first end of each of the extension arms is coupled to the pivot bar. A target holder is provided having a seat portion and a pair of spaced apart holding panels coupled to the seat portion of the target holder. A second end of each of the extension arms is coupled to the seat portion of the target holder. The holding panels of the target holder are adapted for holding a target board.

10 Claims, 3 Drawing Sheets

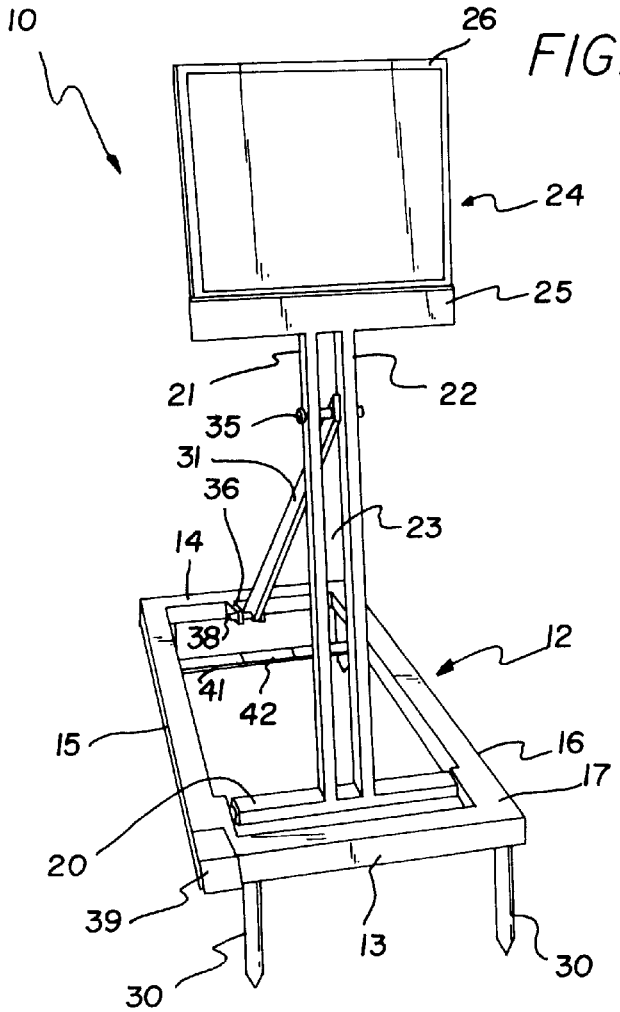
FIG.2
FIG.3
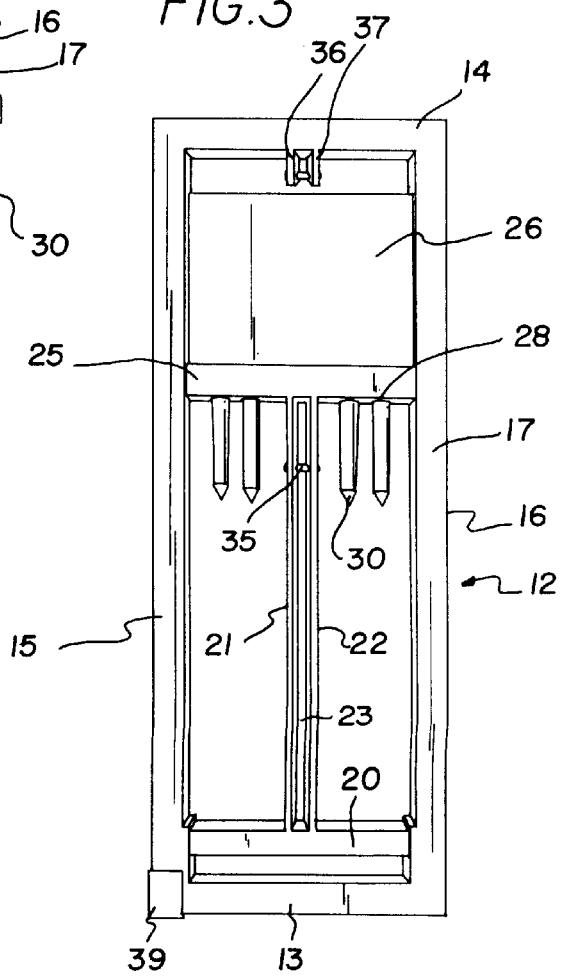

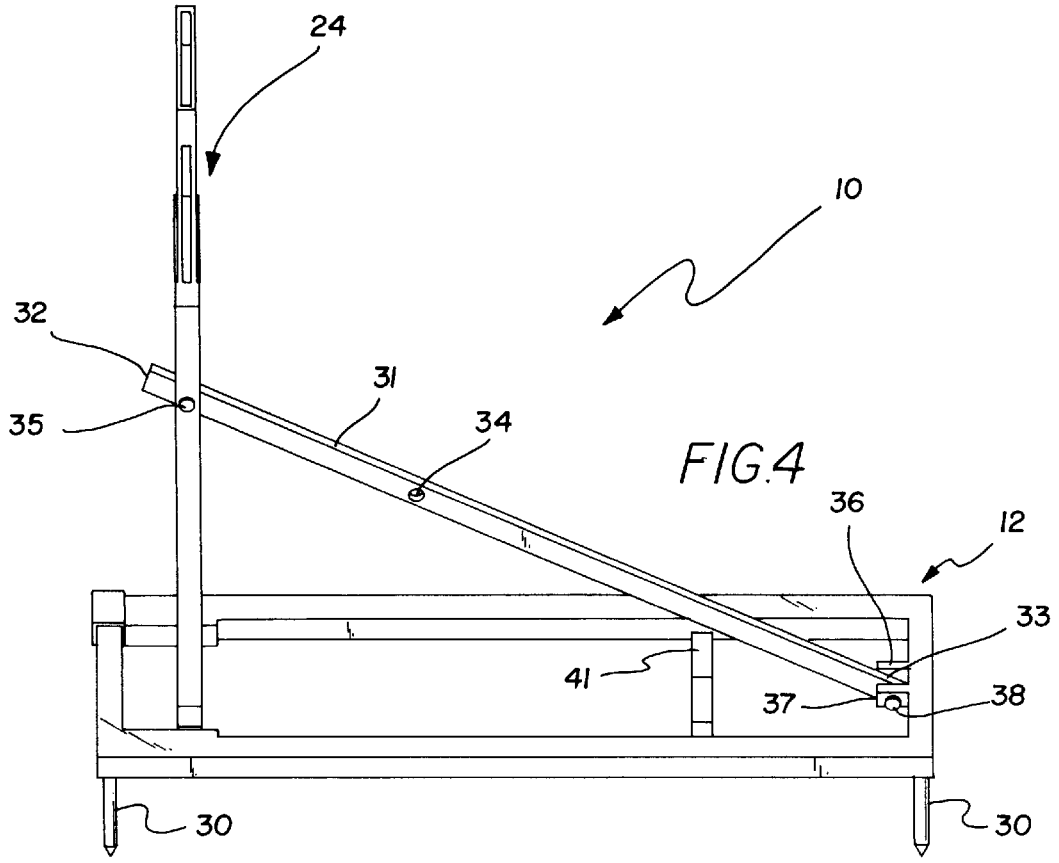
FIG.4
FIG.5
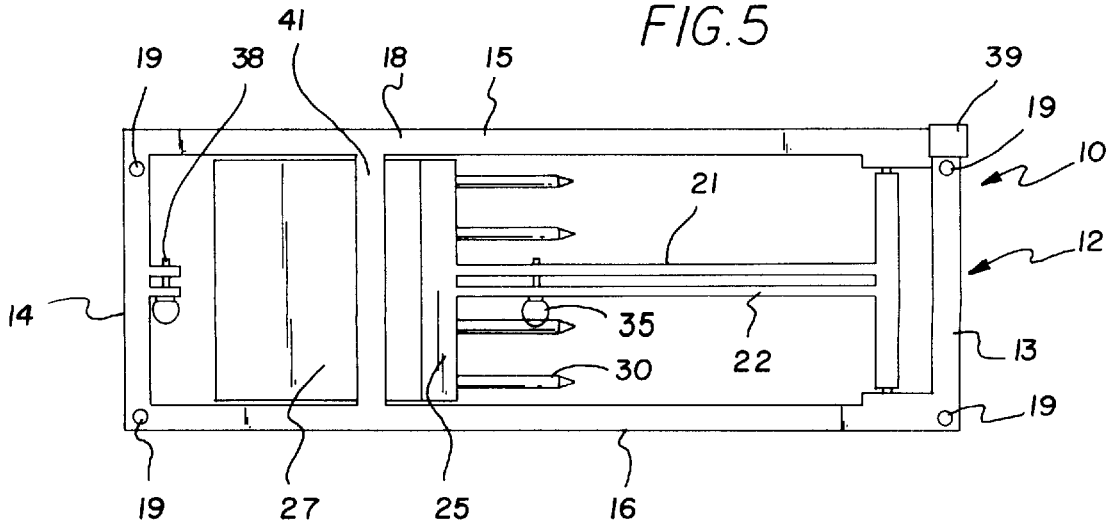

TARGET STAND

BACKGROUND OF THE INVENTION

1. Field of the Invention

The present invention relates to target stands and more particularly pertains to a new target stand for providing a sturdy lightweight device for holding a target above a surface.

2. Description of the Prior Art

The use of target stands is known in the prior art. More specifically, target stands heretofore devised and utilized are known to consist basically of familiar, expected and obvious structural configurations, notwithstanding the myriad of designs encompassed by the crowded prior art which have been developed for the fulfillment of countless objectives and requirements.

Known prior art target stands include U.S. Pat. No. 5,209,492; U.S. Pat. No. 5,503,356; U.S. Pat. No. 2,069,822; U.S. Pat. No. 4,913,389; U.S. Pat. No. 4,726,593; U.S. Pat. No. 2,899,204; U.S. Pat. No. 5,067,683; U.S. Pat. No. 4,029,318; U.S. Pat. No. 2,932,516; U.S. Pat. No. 5,678,824; U.S. Pat. No. 3,601,353; and U.S. Pat. No. Des. 186,773; and PCT Patent No. WO 96/23190; and EPO Patent No. 0 785 407 A2.

While these devices fulfill their respective, particular objectives and requirements, the aforementioned patents do not disclose a new target stand. The inventive device includes the target stand 10 generally comprises a base frame with a pivot bar interposed between the side bars of the base frame. One of the ends of the pivot bar is pivotally coupled to one of the side bars of the base frame while the other end of the pivot bar is pivotally coupled to the other side bar of the base frame. A pair of spaced apart elongate extension arms are included each having a pair of opposite ends. A first end of each of the extension arms is coupled to the pivot bar. A target holder is provided having a seat portion and a pair of spaced apart holding panels coupled to the seat portion of the target holder. A second end of each of the extension arms is coupled to the seat portion of the target holder. The holding panels of the target holder are adapted for holding a target board.

In these respects, the target stand according to the present invention substantially departs from the conventional concepts and designs of the prior art, and in so doing provides an apparatus primarily developed for the purpose of providing a sturdy lightweight device for holding a target above a surface.

SUMMARY OF THE INVENTION

In view of the foregoing disadvantages inherent in the known types of target stands now present in the prior art, the present invention provides a new target stand construction wherein the same can be utilized for providing a sturdy lightweight device for holding a target above a surface.

The general purpose of the present invention, which will be described subsequently in greater detail, is to provide a new target stand apparatus and method which has many of the advantages of the target stands mentioned heretofore and many novel features that result in a new target stand which is not anticipated, rendered obvious, suggested, or even implied by any of the prior art target stands, either alone or in any combination thereof.

To attain this, the present invention generally comprises the target stand 10 generally comprises a base frame with a pivot bar interposed between the side bars of the base frame.

One of the ends of the pivot bar is pivotally coupled to one of the side bars of the base frame while the other end of the pivot bar is pivotally coupled to the other side bar of the base frame. A pair of spaced apart elongate extension arms are included each having a pair of opposite ends. A first end of each of the extension arms is coupled to the pivot bar. A target holder is provided having a seat portion and a pair of spaced apart holding panels coupled to the seat portion of the target holder. A second end of each of the extension arms is coupled to the seat portion of the target holder. The holding panels of the target holder are adapted for holding a target board.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new target stand apparatus and method which has many of the advantages of the target stands mentioned heretofore and many novel features that result in a new target stand which is not anticipated, rendered obvious, suggested, or even implied by any of the prior art target stands, either alone or in any combination thereof.

It is another object of the present invention to provide a new target stand which may be easily and efficiently manufactured and marketed.

It is a further object of the present invention to provide a new target stand which is of a durable and reliable construction.

An even further object of the present invention is to provide a new target stand which is susceptible of a low cost of manufacture with regard to both materials and labor, and which accordingly is then susceptible of low prices of sale to the consuming public, thereby making such target stand economically available to the buying public.

Still yet another object of the present invention is to provide a new target stand which provides in the apparatuses and methods of the prior art some of the advantages thereof, while simultaneously overcoming some of the disadvantages normally associated therewith.

Still another object of the present invention is to provide a new target stand for providing a sturdy lightweight device for holding a target above a surface.

Yet another object of the present invention is to provide a new target stand which includes the target stand 10 generally comprises a base frame with a pivot bar interposed between the side bars of the base frame. One of the ends of the pivot bar is pivotally coupled to one of the side bars of the base frame while the other end of the pivot bar is pivotally coupled to the other side bar of the base frame. A pair of spaced apart elongate extension arms are included each having a pair of opposite ends. A first end of each of the extension arms is coupled to the pivot bar. A target holder is provided having a seat portion and a pair of spaced apart holding panels coupled to the seat portion of the target holder. A second end of each of the extension arms is coupled to the seat portion of the target holder. The holding panels of the target holder are adapted for holding a target board.

Still yet another object of the present invention is to provide a new target stand that may be quickly and easily deployed for use and quickly and easily collapsed for convenient transport and storage.

Even still another object of the present invention is to provide a new target stand that may be used to support a target board vertically on flat ground surfaces as well as on sloped ground surfaces such as a hill.

Still even yet another object of the present invention is to provide a new target stand that raises a target board a distance above the ground surface so that the target board extends above any vegetation on the ground such as weeds and grasses.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a schematic front perspective view of the present invention in the raised position for resting on a generally horizontal ground surface.

FIG. 3 is a schematic top side view of the present invention in a lowered position.

FIG. 4 is a schematic side perspective view of the present invention in a raised position.

FIG. 5 is a schematic bottom side view of the present invention in a lowered position.

DESCRIPTION OF THE PREFERRED EMBODIMENT

Figure 1:
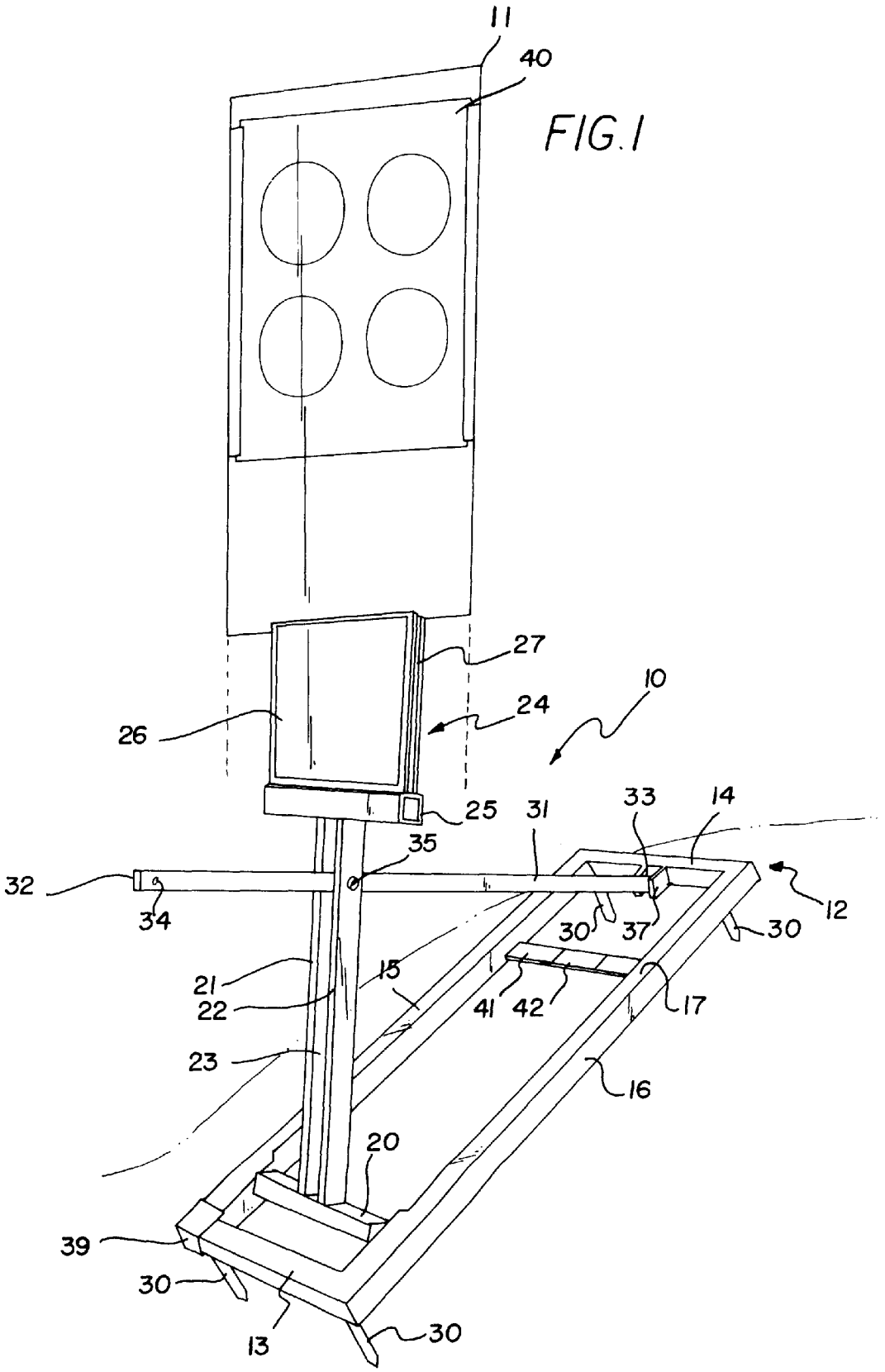
FIG. 1 is a schematic perspective view of a new target stand in a raised position with the base frame extended at an acute angle to the extension arms so that the base frame may be rested on a sloped ground surface according to the present invention.

With reference now to the drawings, and in particular to FIGS. 1 through 5 thereof, a new target stand embodying the principles and concepts of the present invention and generally designated by the reference numeral 10 will be described.

As best illustrated in FIGS. 1 through 5, the target stand 10 generally comprises a base frame 12 with a pivot bar 20 interposed between the side bars 15,16 of the base frame 12. One of the ends of the pivot bar is pivotally coupled to one of the side bars of the base frame while the other end of the pivot bar is pivotally coupled to the other side bar of the base frame. A pair of spaced apart elongate extension arms 21,22 are included each having a pair of opposite ends. A first end of each of the extension arms 21,22 is coupled to the pivot bar 20. A target holder 24 is provided having a seat portion 25 and a pair of spaced apart holding panels 26,27 coupled to the seat portion 25 of the target holder 24. A second end of each of the extension arms 21,22 is coupled to the seat portion 25 of the target holder 24. The holding panels 26,27 of the target holder 24 are adapted for holding a target board 11.

In use, the target stand 10 is designed for supporting a target board 11 to which a paper target 40 may be attached above a ground surface. Specifically, the base frame 12 is designed for resting on a ground surface. The base frame 12 is generally rectangular and has a spaced apart pair of elongate end bars 13,14 and a spaced apart pair of elongate side bars 15,16 extending between the end bars 13,14 of the base frame 12. Each of the bars 13,14,15,16 of the base frame 12 has a longitudinal axis and a generally rectangular cross section taken generally perpendicular to the respective longitudinal axis. Preferably, each of the bars of the base frame 12 is tubular. The longitudinal axes of the end bars 13,14 of the base frame 12 are preferably extended generally parallel to one another and the longitudinal axes of the side bars 15,16 of the base frame 12 are extended generally parallel to one another. In the preferred embodiment, the longitudinal axes of the end bars of the base frame are extended generally perpendicular to the longitudinal axes of the side bars of the base frame. Even more preferably, the bars of the base frame 12 lie in a common plane.

The base frame 12 has a length defined between the end bars of the base frame 12, and a width defined between the side bars 15,16 of the base frame 12. Preferably, the width of the base frame 12 is less than one half the length of the base frame 12. In an ideal illustrative embodiment, the width of the base frame 12 is less about 10 inches and the length of the base frame 12 is about 27½ inches. In this ideal illustrative embodiment, each of the bars of the base frame 12 has a width of about 1 inch.

The base frame 12 also has a top 17 and a bottom 18. The base frame 12 has a corner formed at each intersection of an end bar 13,14 of the base frame 12 and a side bar 15,16 of the base frame 12. The bottom 18 of the base frame 12 has four threaded holes 19 therein. Each of the corners of the base frame 12 has a threaded hole of the bottom 18 of the base frame 12 positioned adjacent to it. A plurality of anchor pins 30 designed for insertion into the ground to help hold the target stand upright on the ground surface are provided. Ideally, the plurality of anchor pins 30 comprises four anchor pins 30. Each of the anchor pins 30 has a pointed end and a threaded end. The pointed end of the anchor pin is designed for inserting into the ground while, as illustrated in FIGS. 1, 2, and 4, the threaded end of each anchor pin is threadably insertable into a threaded hole 19 of the bottom 18 of the base frame 12 to attach the anchor pin to the bottom 18 of the base frame 12.

The elongate pivot bar 20 has a pair of opposite ends and a longitudinal axis extending between the ends of the pivot bar 20. Preferably, the pivot bar 20 has a generally rectangular cross section taken generally perpendicular to the longitudinal axis of the pivot bar 20. The pivot bar 20 is interposed between the side bars 15,16 of the base frame 12. One of the ends of the pivot bar 20 is pivotally coupled to one of the side bars of the base frame 12 while the other of the ends of the pivot bar 20 is pivotally coupled to another of the side bars of the base frame 12. The pivot bar 20 is preferably located towards a first or front end bar 13 of the pair of end bars of the base frame 12. The longitudinal axis of the pivot bar 20 is extended generally parallel to the longitudinal axis of the first end bar 13 of the base frame 12.

The target stand also includes a pair of spaced apart elongate extension arms 21,22. Each of the extension arms 21,22 has a pair of opposite ends and a longitudinal axis extending between the ends of the extension arm. Ideally, each of the extension arms 21,22 has a generally rectangular cross section taken generally perpendicular to the longitudinal axis of the extension arm. Preferably, the longitudinal axes of the extension arms 21,22 are generally parallel to each other so that the extension arms 21,22 define an elongate slot 23 therebetween. A first end of the pair of ends of each of the extension arms 21,22 is coupled to the pivot bar 20. The first end of each of the extension arms 21,22 is positioned between the ends of the pivot bar 20.

The target holder 24 is designed for holding a target board 11. The target holder 24 has a seat portion 25 and a pair of spaced apart holding panels 26,27 coupled to the seat portion 25 of the target holder 24. The seat portion 25 of the target holder 24 has a pair of opposite ends and a longitudinal axis extending between the ends of the seat portion 25 of the target holder 24. The seat portion 25 of the target holder 24 preferably has a generally rectangular cross section taken generally perpendicular to the seat portion 25 of the target holder 24. The second end of the pair of ends of each of the extension arms 21,22 is coupled to the seat portion 25 of the target holder 24. The second ends of the extension arms 21,22 are preferably positioned between the ends of the seat portion 25 of the target holder 24. The holding panels 26,27 of the target holder 24 are adapted for holding a target board 11 (ideally, ⅜ inch thick board) inserted therebetween. The holding panels 26,27 of the target holder 24 are generally planar and rectangular. The holding panels 26,27 are outwardly extended from the seat portion 25 of the target holder 24 in a direction generally diametrically opposite to the location the second ends of the extension arms 21,22 are coupled to the seat portion 25 of the target holder 24. The holding panels 26,27 of the target holder 24 preferably lie in generally parallel planes. In the ideal illustrative embodiment, the target holder 24 has a width as measured between the ends of the seat portion 25 of less than about 8 inches and a length as measured between the seat portion 25 and the free edges of the holding panels 26,27 of about 7 inches.

Preferably, the seat portion 25 of the target holder 24 has a plurality of threaded bores 28 therein distal the holding panels 26,27 and on the same side as the second ends of the extension arms 21,22. Ideally, the plurality of threaded bores 28 of the seat portion 25 of the target holder 24 comprise four threaded bores with a pair of threaded bores located on the seat portion 25 on either side of the second ends of the extension arms 21,22. In use, the threaded ends of the anchor pins 30 is threadably insertable into the threaded bores of the seat portion 25 of the target holder 24 for convenient storage of the anchor pins 30 when the target stand is not in use supporting a target board 11.

In use, the pivot bar 20 is pivotable between a raised position (FIGS. 1, 2, and 4) and a lowered position (FIGS. 3 and 5). The extension arms 21,22 and the target holder 24 are outwardly extended from the top 17 of the base frame 12 when the pivot bar 20 is pivoted towards the raised position. When in the lowered positioned, the extension arms 21,22 and the target holder 24 lie in the same plane as the base frame 12.

Preferably, an elongate support rod 31 having a pair of opposite ends 32,33 is provided with the target stand 10. The support rod 31 has a plurality of holes 34 therethrough. Each of the ends of the support rod 31 has a hole 34 located adjacent to it. The support rod also has at least one more hole 34 located between the end holes of the support rod 31. As illustrated in FIGS. 1, 2, and 4, the support rod 31 is designed for providing additional support to the holding of the target board 11 when the extension arms 21,22 and the target holder 24 are pivoted towards the raised position by the pivot bar 20.

The second end bar 14 of the pair of end bars of the base frame 12 has a pair of spaced apart tabs 36,37 extending therefrom towards the first end bar 13 of the base frame 12. Each of the tabs 36,37 has a mounting hole therethrough which are generally coaxial with one another. Each of the extension arms 21,22 has a mounting hole therethrough which are also generally coaxial with each other. Preferably, the mounting holes of the extension arms are positioned towards the second ends of the extension arms 21,22. As illustrated in FIGS. 2 and 4, one of the ends 32 of the support rod 31 is extended between the extension arms 21,22 and a first quick release mounting pin 35 is extendable through the holes of the extension arms 21,22 and the hole of the support rod 31 positioned adjacent the one end of the support rod 31 to attach the one end of the support rod 31 to the extension arms 21,22. Optionally, when resting the target stand on a sloped surface the first quick release pin 35 my be extended through the mounting holes of the extension arms 21,22 and the middle hole of the support rod 31 between the ends of the support rod 31 as illustrated in FIG. 1. The other end of the support rod 31 is extended between the tabs 36,37 and a second quick release mounting pin 38 is extendable through the holes of the tabs 36,37 and the hole of the support rod 31 positioned adjacent the another end of the support rod 31 to attach the another end of the support rod 31 to the tabs 36,37.

Preferably, an elongate backing plate 41 is extended between the side bars 15,16 of the base frame 12. The backing plate 41 is positioned adjacent the bottom 18 of the base frame 12 and located towards the second end bar 14 of the base frame 12. The backing plate 41 is designed for permitting resting of the target holder 24 when the target holder 24 is in the lowered position to prevent the target holder 24 from pivoting in a direction outwards from the bottom 18 of the base frame 12. Preferably, a hook and loop fastener 42 provided on the target holder 24 and the backing plate 41 detachably holds the target holder 24 to the backing plate when in the lowered position.

In the preferred embodiment, the base frame 12 has an elongate space therein adapted for receiving the support rod 31 therein for convenient storage when not in use. The space of the base frame 12 is preferably located in one of the side bars of the base frame with an opening into the space located adjacent one of the corners of the base frame. Preferably, an end cover 39 such a flexible flap of one portion of a hook and loop fastener covers the opening into the space of the base frame 12. Optionally, the base frame 12 may include a second space provided in the other side bar of the base frame 12.

In use, the target stand 10 is used to support a target board between the holding panels of the target holder when in the raised position. The support rod helps hold the target holder upright against the force of an object such as a bullet striking the target board or from the force of a wind blowing on the target board.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A target stand, comprising:

a base frame having a spaced apart pair of elongate end bars and a spaced apart pair of elongate side bars extending between said end bars of said base frame;

an elongate pivot bar having a pair of opposite ends, said pivot bar being interposed between said side bars of said base frame, one of said ends of said pivot bar being pivotally coupled to one of said side bars of said base frame, another of said ends of said pivot bar being pivotally coupled to another of said side bars of said base frame;

a pair of spaced apart elongate extension arms, each of said extension arms having a pair of opposite ends and a longitudinal axis extending between said ends of said extension arm, a first end of said pair of ends of each of said extension arms being coupled to said pivot bar;

a target holder having a seat portion and a pair of spaced apart holding panels coupled to said seat portion of said target holder;

a second end of said pair of ends of each of said extension arms being coupled to said seat portion of said target holder, said second ends of said extension arms being positioned between said ends of said seat portion of said target holder; and said holding panels of said target holder being adapted for holding a target board.

2. The target stand of claim 1, wherein each of said bars of said base frame has a longitudinal axis and a generally rectangular cross section taken generally perpendicular to the respective longitudinal axis.

3. The target stand of claim 2, wherein said longitudinal axes of said end bars of said base frame are extended generally parallel to one another, said longitudinal axes of said side bars of said base frame are extended generally parallel to one another, said longitudinal axes of said end bars of said base frame are extended generally perpendicular to said longitudinal axes of said side bars of said base frame.

4. The target stand of claim 2, wherein said bars of said base frame lie in a common plane.

5. The target stand of claim 1, wherein said base frame has a top and a bottom, and wherein said bottom of said base frame has a plurality of threaded holes therein, and further comprising a plurality of anchor pins, each of said anchor pins having a threaded end, said threaded end of each anchor pin being threadably insertable into a threaded hole of said bottom of said base frame.

6. The target stand of claim 1, wherein said holding panels of said target holder are generally planar and rectangular, and wherein said holding panels of said target holder lie in generally parallel planes.

7. The target stand of claim 1, wherein said seat portion of said target holder has a plurality of threaded bores therein, and further comprising a plurality of anchor pins, each of said anchor pins having a threaded end, said threaded ends of said anchor pins being threadably insertable into said threaded bores of said seat portion of said target holder.

8. The target stand of claim 1, further comprising an elongate support rod having a pair of opposite ends, said support rod having a plurality of holes therethrough, each of said ends of said support rod having a hole of said plurality of holes of said support rod located there adjacent, wherein a second end bar of said pair of end bars of said base frame has a pair of spaced apart tabs extending therefrom towards said first end bar of said base frame, each of said tabs having a mounting hole therethrough, said mounting holes of said tabs being generally coaxial with one another, wherein each of said extension arms has a mounting hole therethrough, said mounting holes of said extension arms being generally coaxial with each other and being positioned towards said second ends of said extension arms, wherein one of said ends of said support rod is extended between said extension arms, a first mounting pin being extendable through said holes of said extension arms and said hole of said support rod positioned adjacent said one end of said support rod to attach said one end of said support rod to said extension arms, and wherein another of said ends of said support rod being extended between said tabs, a second mounting pin being extendable through said holes of said tabs and said hole of said support rod positioned adjacent said another end of said support rod to attach said another end of said support rod to said tabs.

9. The target stand of claim 1, further comprising an elongate backing plate being extended between said side bars of said base frame, said backing plate being positioned adjacent said bottom of said base frame, said backing plate being located towards said second end bar of said base frame.

10. A target stand for supporting a target board above a ground surface, said target stand comprising:

a base frame being generally rectangular and having a spaced apart pair of elongate end bars and a spaced apart pair of elongate side bars extending between said end bars of said base frame;

each of said bars of said base frame having a longitudinal axis and a generally rectangular cross section taken generally perpendicular to the respective longitudinal axis, each of said bars of said base frame being tubular;

said longitudinal axes of said end bars of said base frame being extended generally parallel to one another, said longitudinal axes of said side bars of said base frame being extended generally parallel to one another, said longitudinal axes of said end bars of said base frame being extended generally perpendicular to said longitudinal axes of said side bars of said base frame;

said bars of said base frame lying in a common plane;

said base frame having a top and a bottom;

said base frame having a corner formed at each intersection of an end bar of said base frame and a side bar of said base frame;

said bottom of said base frame having a plurality of threaded holes therein, wherein said plurality of threaded holes of said bottom of said base frame comprises four threaded holes, each of said corners of said base frame having a threaded hole of said bottom of said base frame positioned there adjacent;

a plurality of anchor pins, wherein said plurality of anchor pins comprises four anchor pins, each of said anchor pins having a pointed end and a threaded end, said threaded end of each anchor pin being threadably insertable into a threaded hole of said bottom of said base frame;

an elongate pivot bar having a pair of opposite ends and a longitudinal axis extending between said ends of said pivot bar, wherein said pivot bar has a generally rectangular cross section taken generally perpendicular to said longitudinal axis of said pivot bar;

said pivot bar being interposed between said side bars of said base frame, one of said ends of said pivot bar being pivotally coupled to one of said side bars of said base frame, another of said ends of said pivot bar being pivotally coupled to another of said side bars of said base frame;

said pivot bar being located towards a first end bar of said pair of end bars of said base frame, said longitudinal axis of said pivot bar being extended generally parallel to said longitudinal axis of said first end bar of said base frame;

a pair of spaced apart elongate extension arms, each of said extension arms having a pair of opposite ends and a longitudinal axis extending between said ends of said extension arm, wherein each of said extension arms has a generally rectangular cross section taken generally perpendicular to said longitudinal axis of said extension arm, said longitudinal axes of said extension arms being generally parallel to each other, said extension arms defining an elongate slot therebetween, a first end of said pair of ends of each of said extension arms being coupled to said pivot bar, said first end of each of said extension arms being positioned between said ends of said pivot bar;

a target holder having a seat portion and a pair of spaced apart holding panels coupled to said seat portion of said target holder;

said seat portion of said target holder having a pair of opposite ends and a longitudinal axis extending between said ends of said seat portion of said target holder, said seat portion of said target holder having a generally rectangular cross section taken generally perpendicular to said seat portion of said target holder;

a second end of said pair of ends of each of said extension arms being coupled to said seat portion of said target holder, said second ends of said extension arms being positioned between said ends of said seat portion of said target holder;

said holding panels of said target holder being generally planar and rectangular, said holding panels of said target holder lying in generally parallel planes, said holding panels of said target holder being adapted for holding a target board therebetween;

said seat portion of said target holder having a plurality of threaded bores therein, wherein said plurality of threaded bores of said seat portion of said target holder comprises four threaded bores, said threaded ends of said anchor pins being threadably insertable into said threaded bores of said seat portion of said target holder;

an elongate support rod having a pair of opposite ends, said support rod having a plurality of holes therethrough, each of said ends of said support rod having a hole of said plurality of holes of said support rod located there adjacent, a third hole of said plurality of holes of said support rod being located between said holes of said support rod located adjacent said ends of said support rod;

a second end bar of said pair of end bars of said base frame having a pair of spaced apart tabs extending therefrom towards said first end bar of said base frame, each of said tabs having a mounting hole therethrough, said mounting holes of said tabs being generally coaxial with one another;

each of said extension arms having a mounting hole therethrough, said mounting holes of said extension arms being generally coaxial with each other and being positioned towards said second ends of said extension arms;

one of said ends of said support rod being extended between said extension arms, a first mounting pin being extendable through said holes of said extension arms and said hole of said support rod positioned adjacent said one end of said support rod to attach said one end of said support rod to said extension arms;

another of said ends of said support rod being extended between said tabs, a second mounting pin being extendable through said holes of said tabs and said hole of said support rod positioned adjacent said another end of said support rod to attach said another end of said support rod to said tabs; and an elongate backing plate being extended between said side bars of said base frame, said backing plate being positioned adjacent said bottom of said base frame, said backing plate being located towards said second end bar of said base frame.

* * * * *